US009560881B2

(12) United States Patent
Hoffmann et al.

(10) Patent No.: US 9,560,881 B2
(45) Date of Patent: Feb. 7, 2017

(54) SMOKELESS CIGARETTE AND METHOD FOR THE PRODUCTION THEREOF

(75) Inventors: Hans-Jürgen Hoffmann, Köln (DE); Peter Bendzko, Berlin (DE)

(73) Assignee: ESSENTRA PTE. LTD, Singapore (SG)

( * ) Notice: Subject to any disclaimer, the term of this patent is extended or adjusted under 35 U.S.C. 154(b) by 1038 days.

(21) Appl. No.: 12/531,372

(22) PCT Filed: Mar. 16, 2008

(86) PCT No.: PCT/DE2008/000458
§ 371 (c)(1),
(2), (4) Date: Nov. 20, 2009

(87) PCT Pub. No.: WO2008/113335
PCT Pub. Date: Sep. 25, 2008

(65) Prior Publication Data

US 2010/0059073 A1 Mar. 11, 2010

(30) Foreign Application Priority Data

Mar. 16, 2007 (DE) ..... 10 2007 013 541
Mar. 30, 2007 (DE) ..... 10 2007 015 350

(51) Int. Cl.
*A24F 47/00* (2006.01)

(52) U.S. Cl.
CPC ..... *A24F 47/002* (2013.01)

(58) Field of Classification Search
None
See application file for complete search history.

(56) References Cited

U.S. PATENT DOCUMENTS 3,258,015 A * 6/1966 Drummond et al. ..... 131/273
4,800,903 A 1/1989 Ray
(Continued)

FOREIGN PATENT DOCUMENTS

DE 102005016415 A1 11/2006
EP 0364805 A 4/1990
(Continued)

OTHER PUBLICATIONS

English Language Abstract for DE 10 2005 016415, Nov. 2, 2006.
English Language Abstract for EP 0364805, Jan. 18, 1995.
English Language Abstract for WO 2006/002445, Jan. 12, 2006.

*Primary Examiner* — Michael J Felton
(74) *Attorney, Agent, or Firm* — Norris McLaughlin & Marcus PA

(57) ABSTRACT

Disclosed is a smokeless cigarette system comprising a reusable cigarette tube and a nicotine stick which can be discarded after use. The nicotine stick comprises a depot filter charged with a nanobead solution and nicotine and flavor substances attached thereto or incorporated therein, and a mouthpiece filter, which are joined together and produced at the factory stage. The disclosed smokeless cigarette is particularly suited for use in non-smoking areas to prevent stress caused by nicotine withdrawal and as a cigarette substitute, but can also be used in different types of cigarettes with varied dosage strengths to ensure gentle nicotine withdrawal and smoke disintoxication. Neither the environment nor other persons are harmed of put at risk by this system by either passive smoking or the generation of odour. The system can be handled in a simple and unproblematic manner since no heat source or heating systems are required.

18 Claims, 12 Drawing Sheets

Nicotine stic (5) with cigarette tube (1)

(56) References Cited

U.S. PATENT DOCUMENTS

| | | | | |
|---|---|---|---|---|
| 5,137,034 | A * | 8/1992 | Perfetti et al. | 131/194 |
| 6,098,632 | A | 8/2000 | Turner | |
| 2004/0047803 | A1* | 3/2004 | Valtchev et al. | 423/716 |
| 2005/0169849 | A1 | 8/2005 | Farr | |

FOREIGN PATENT DOCUMENTS

| | | | |
|---|---|---|---|
| WO | 2006/002445 | A | 1/2006 |
| WO | 2006/070288 | A | 7/2006 |

* cited by examiner

| | |
|---|---|
| Length | 30,00mm +/- 0,5 |
| Diameter | 4,5 mm +/- 0,5 |
| Diameter bore | 1,00 mm |
| Wall thickness | 0,15 mm |
| Density of the material | 0,220 g/cm$^3$ |
| Total weight | 130 mg (gross) |
| Fibre material | PE-fibre |
| Covering material | PP, nature |

Depot filter 4,5mm

Mouthpiece filter Fig. 2
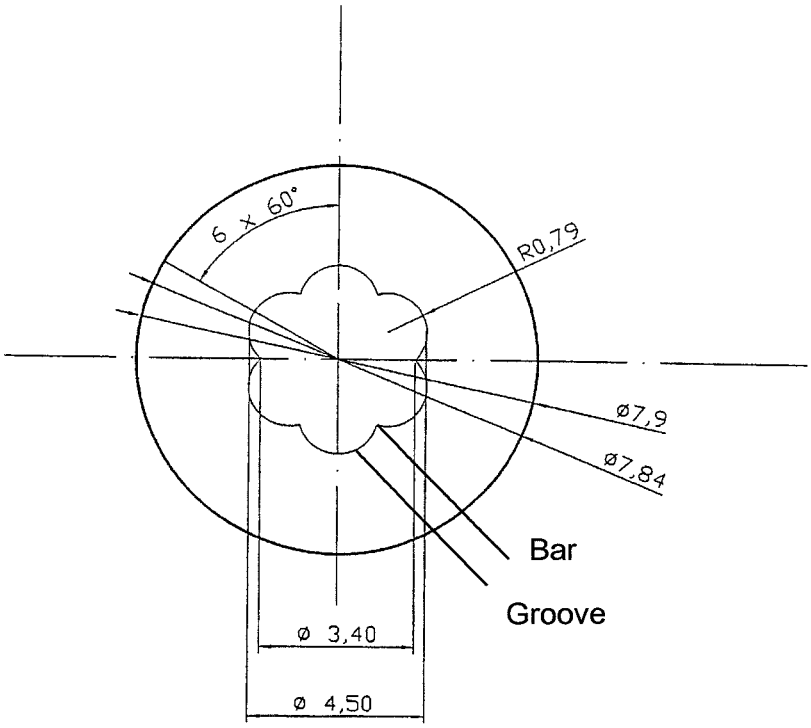
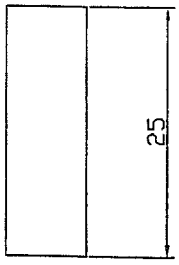
| | |
|---|---|
| Length | 25,00 mm +/- 0,5 |
| Diameter | 7,900 mm +/- 0,05 |
| Diameter bore | floral design |
| Fibre material | AC-Fibre |
| Covering-material | Paper with subereous design |

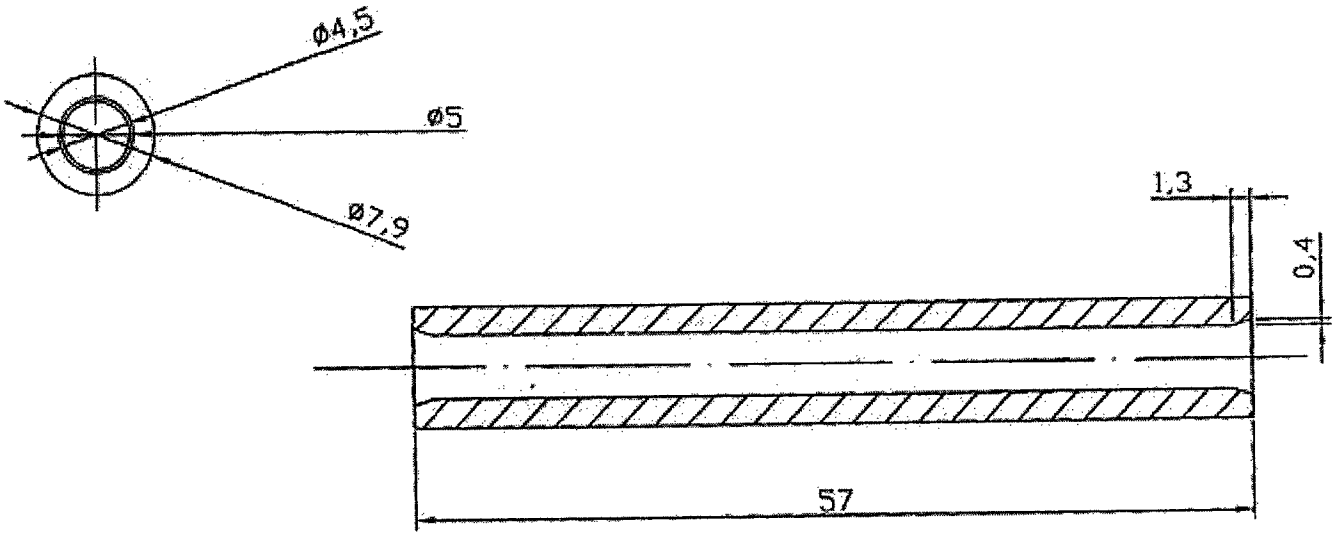
Cigarette Tube Fig. 3

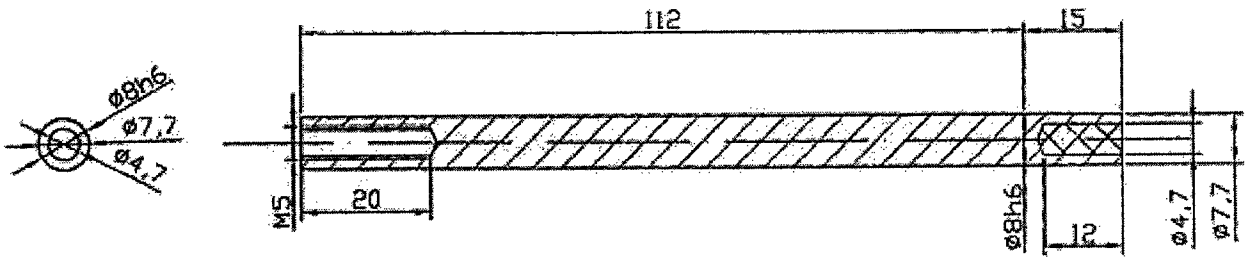
Surface: Rz 8
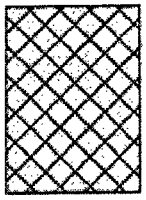
Nikotinstic Fig. 4

Nicotine stick robot

Nicotine stick robot

Figure 9:
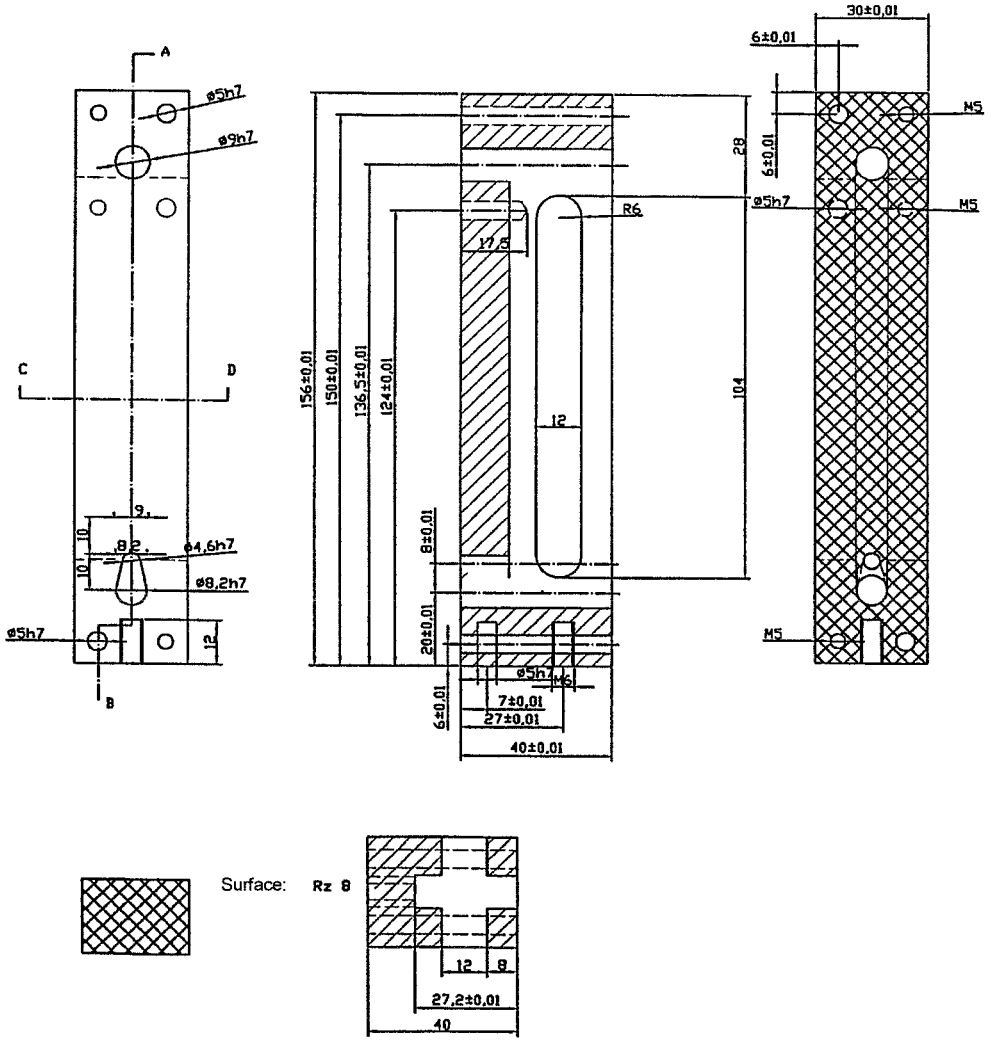

Nicotine stick robot Fig. 9

Inlet depot filter
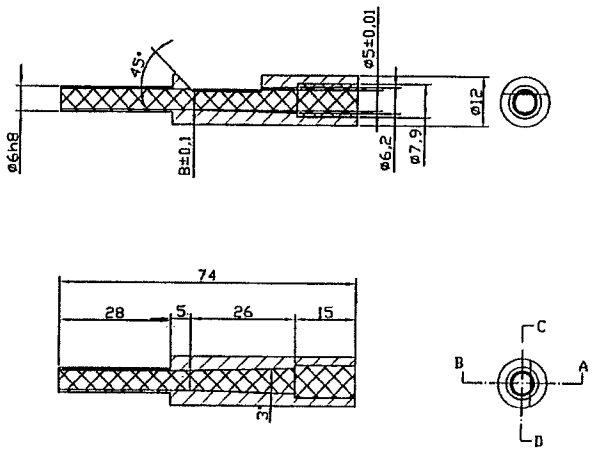
Nicotine stick robot
Fig. 10
Discharge Mouthpiece filter
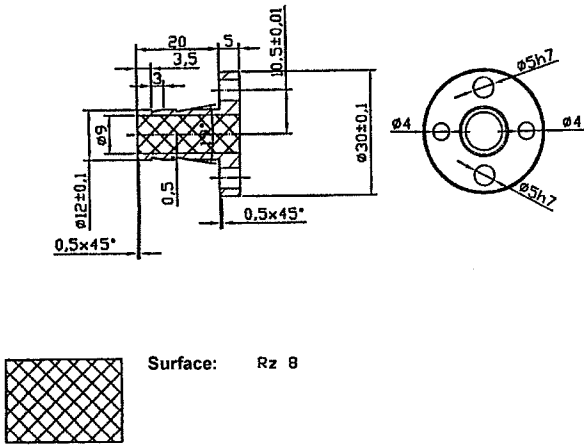

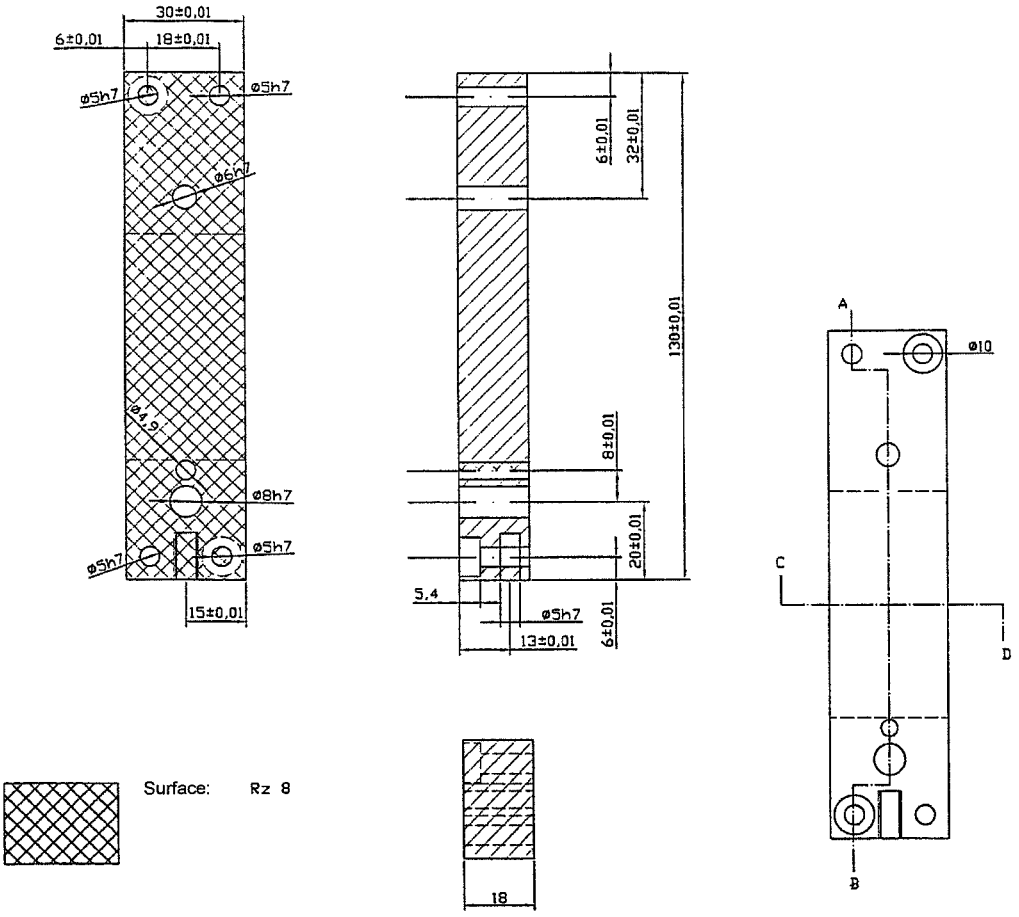
Nicotine stick robot Fig. 11

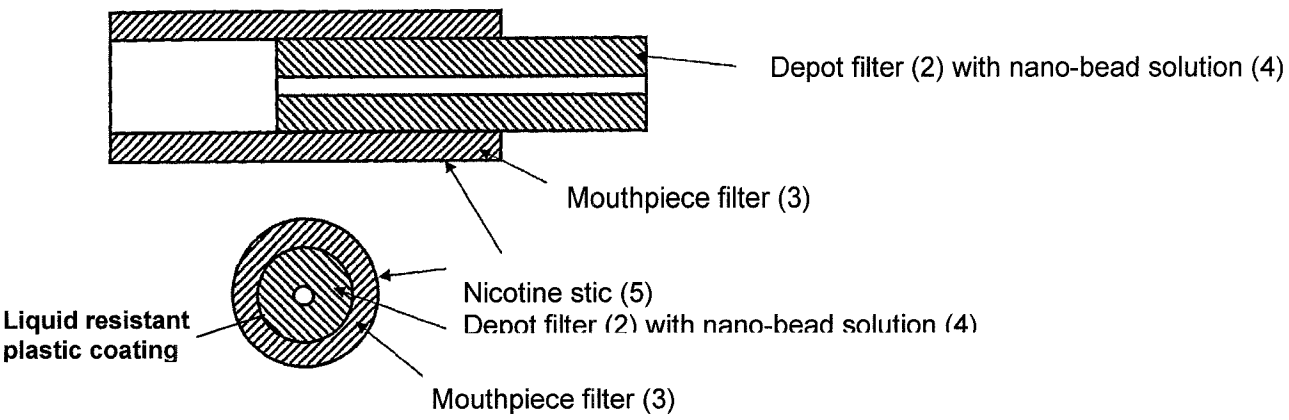
Fig. 12 A: Mouthpiece filter (3) with inserted depot filter (2) = nicotine stic (5)
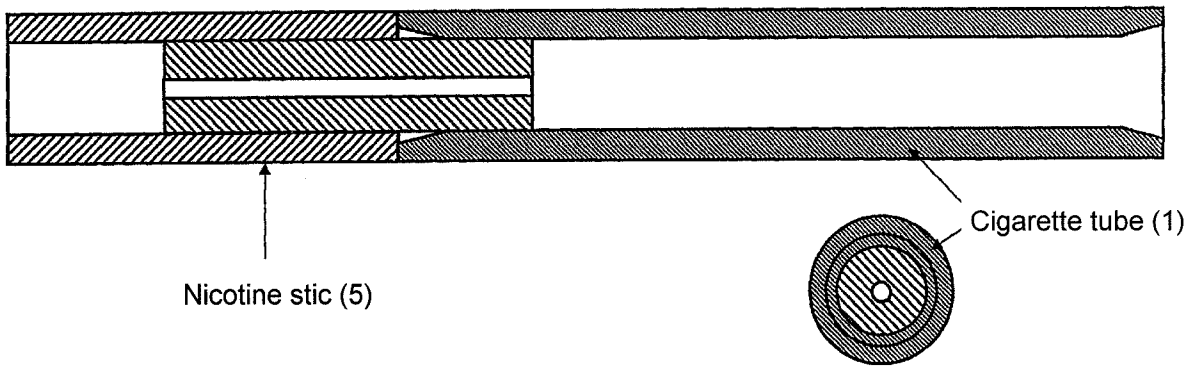
Fig. 12 B: Nicotine stic (5) with cigarette tube (1)

SMOKELESS CIGARETTE AND METHOD FOR THE PRODUCTION THEREOF

This application is a 371 application of PCT/DE2008/000458 filed Mar. 13, 2008, which claims priority to the German application 10 2007 013 541.8 filed Mar. 16, 2007 and German application 10 2007 015 350.5 filed Mar. 30, 2007.

The invention relates to a new smokeless nicotine inhalator, preferably in the design and the external dimensions of a cigarette, comprising an inhalator tube, a mouthpiece filter and a depot filter with nano-beads and/or organic materials such as sugar or amino-acids, in which nicotine and preferably flavour substances have been deposited or stored on the nano-beads and/or organic substances such as sugar or amino-acids. It further relates to a method for the manufacture and the use of the smokeless cigarette. Fields of application of the invention are the health service, the consumables industry, bars and restaurants and public buildings.

In recent years, an increasing trend towards bans on smoking in public buildings or areas, at workplaces, in aircraft, in trains, restaurants and bars etc. has been seen. The reasons for this are to be found in the fact that smoking contains highly health-endangering risks for the smokers themselves and, on the other hand, there is a severe risk for the environment and non-smokers by passive smoking. However, as a rule, non-smoking bans are connected with considerable stress situations and problems for the smokers, e.g. nicotine withdrawal, and lead to increased risk problems.

Suggestions have already been made to remedy the noxious effects of cigarette smoke without limiting the effects of nicotine (inter alia in DEOS 102005016415A1 Title "Nic-Stic filter connection for smokeless cigarettes").

The smokeless cigarette systems currently on the market all have one distinct disadvantage: as nicotine only volatilises and can thus be "smoked" at a certain temperature (above 80° C.), these systems have to heat the nicotine and volatilise it with heat, also with addition of volatilising substances, e.g. alcohols.

This means that these systems need additional devices such as heating rods in the cigarette papers and charging stations to charge the heating rods. The fact that these systems no longer correspond to cigarettes with a view to their size and/or weight is system-inherent. Above all, these devices are not in a position to achieve temperatures of 80° C., which is why the nicotine yield is so low that practically no nicotine content can be measured in the smoked air (inhalation air). The reason is to be found in the practically non- or hardly existent volatilisation of the nicotine by weak sources of heat.

Thus, the invention was based on the task of providing a smokeless cigarette which enables the smoker to provide the required nicotine without problems in use, without heating and without electrical charging (additional devices), which can be used everywhere and universally and which does not pollute the environment and non-smokers in any way, either through smells or through substances and condensates with a health risk, thus representing an optimal compromise in the living together of smokers and non-smokers. A further task entailed providing a simple and reasonably priced method for the manufacture of a smokeless cigarette. This smokeless cigarette system, which is preferably a smokeless cigarette, is defined as a cold-smoke cigarette.

This task is solved by a smokeless cigarette according to Claim 1, the manufacturing method according to Claims 20-21 and its use according to Claims 22-23. All the other claims are preferential variants.

Completely surprisingly, it was seen that a smokeless cigarette manifesting particularly beneficial properties can be manufactured by filling a nicotine depot with mineral nano-beads and/or other organic substances, e.g. sugar, amino-acids etc., to which nicotine and, if applicable, further flavour substances have been attached or stored and insertion of the nicotine depot into a mouthpiece. In combination with an inhalator tube (cigarette tube), a smokeless cigarette which can be held in the hand and the mouth and used by the final consumer like a conventional cigarette is produced.

Below, the smokeless cigarette system is described is more detail (principal portrayal 12 A, 12 B).

The inhalator tube is defined as a cigarette tube (1). The nicotine depot is defined as a depot filter (2). The mouthpiece is defined as a mouthpiece filter (3). The nicotine solution attached to mineral nano-beads and/or other organic substances is defined as nano-bead solution (4).

The filter composition, composed of mouthpiece filter (3) and depot filter (2) is defined as nicotine stick (5).

The depot filter (2) is such that it is suitable for the cigarette system according to the invention. The depot filter (2) manifests at least one of the following properties, preferably a combination of said properties. The depot filter (2) is produced of plastic, preferably of polyethylene fibres or sintered polyethylene, cylindrical with an inner bore. The length of the depot filter (2) is 25-35 mm, preferably 30 mm+/−0.5 mm. The external diameter of the depot filter (2) is 4-5 mm, preferably 4.5 mm+/−0.05 mm. The internal bore diameter is 1-2 mm, preferably 1.0 mm. With the inner bore of the depot filter, the draw resistance is controlled in inhaling (smoking). The draw resistance is to match that of a normal cigarette, 95-100 mm WG. The density of the depot filter is 0.2 to 0.4 g/cm$^3$, preferably 0.220 g/cm$^3$. The density of the depot filter (2) is used to control the max. absorption quantity of the nano-bead solution and the strength of the nicotine provided at 500-1500 ml draw volume, preferably 1000 ml draw volume with 2-6 draws per minute, preferably 4 draws per minute, with a total of 10-20 draws as a smoking parameter of a cigarette, preferably 16 draws. The nicotine supply (inhalation) as a result of the invention is defined as follows with the aforementioned parameters:

0.1-0.3 mg nicotine content, preferably 0.2 mg for a light version with 16 draws as a smoking parameter, 0.4-0.6 mg nicotine content, preferably 0.5 mg for a medium version with 16 draws as a smoking parameter.

0.6-0.8 mg nicotine content, preferably 0.7 mg for a strong version with 16 draws as a smoking parameter.

The wall thickness of the depot filter (2) is 2-3 mm, the foil strength 0.1-0.2 mm, preferably 0.15 mm. The total weight of the depot filter (2) is between 90 and 150 mg (gross), preferably 130 mg (gross).

Figure 1:
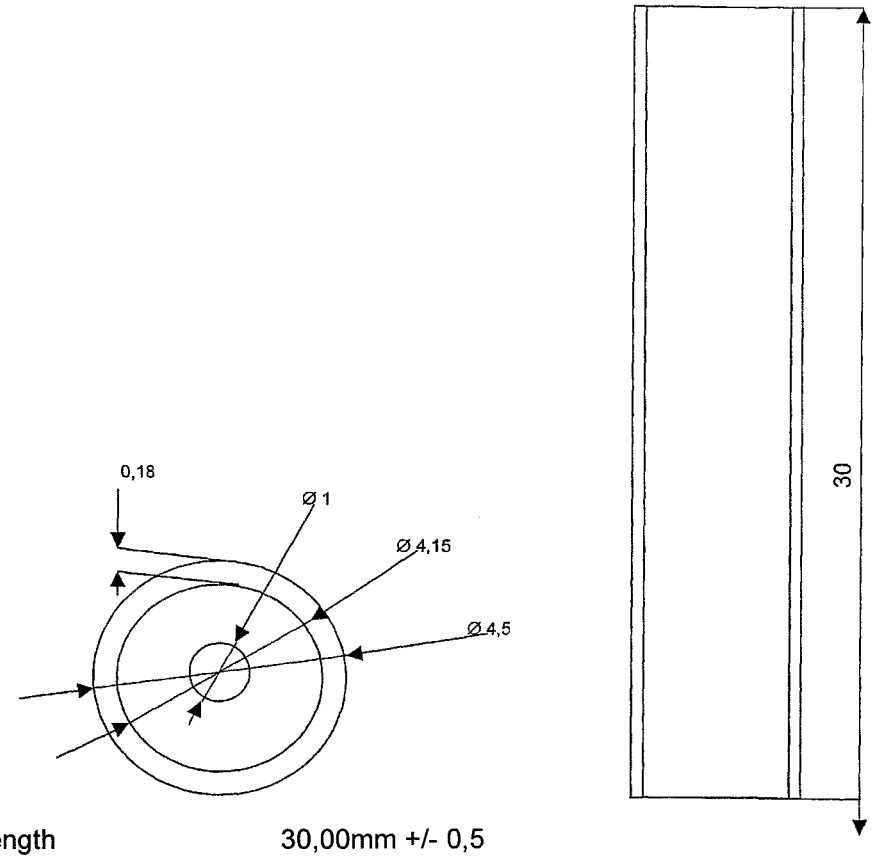

Laterally, the depot filter (2) has been covered with a liquid-resistant, preferably natural coloured plastic foil, preferably of polypropylene. This plastic foil prevents the nano-bead solution (4) from passing from the depot filter (2) to the mouthpiece filter (3) and causing the air to be guided through the depot filter (2) in inhalation (smoking) (FIG. 1).

The depot filter (2) according to the invention is inserted or glued into a mouthpiece filter (3), preferably pressed, as a result of which a particularly simple manufacture, a stable fitting and a minimum emission of polluting substances are guaranteed in use without adhesive or dowelling. As a result of the filling of the depot filter (2) with the nano-bead solution (4), a nicotine stick (5) has been manufactured in this way.

The mouthpiece filter (3) has been designed in a way making it suitable for the cigarette system according to the invention. For this, the mouthpiece filter (3) manifests at least one of the following features, preferably a combination of said features. The mouthpiece filter (3) is made of plastic, preferably acetate cellulose fibre material, cylindrical with a star-shaped inner bore. The lateral part of the cylinder has been covered with cigarette filter paper, preferably cork-design paper, and manifests the design of a normal cigarette filter. The cylindrical mouthpiece filter (3) has a length of 24-26 mm, preferably 25 mm+/−0.5 mm. The outer diameter of the mouthpiece filter (3) is 7-9 mm, preferably 7.9 mm+/−0.05 mm. The inner bore of the mouthpiece filter is star-shaped (flower design), i.e. the bore of the mouthpiece filter (3) has 4-8 bars and correspondingly 4-8 grooves, preferably 6 bars and 6 grooves, across the whole length of the inner bore. The diameter of the grooves (centre groove to centre groove) is 4-5 mm, preferably 4.5 mm. The diameter of the rods (centre rod to centre opposite rod) is 3-4 mm, preferably 3.4 mm. As a result of this specific design, the depot filter (2) is jammed sufficiently tightly and securely in the mouthpiece filter (3) in manufacture, i.e. the depot filter (2) is securely and simply anchored and jammed in the mouthpiece filter (3) in the production process as a result of the flexible rods of the inner bore of the mouthpiece filter (3), but can nevertheless be used comfortably and simply by the user. Further, the inner bore of the mouthpiece filter (3) has the task of guiding the inhalation air flow directly from the depot filter (2) into the user's mouth in smoking without further filter activity. No losses of nano-bead solution (4) are to occur as a result of filter activity of the mouthpiece filter (3) (FIG. 2: mouthpiece filter). The depot filter (2) has been filled with a nano-bead solution (4) according to the invention, making a particularly simple and controlled release of nicotine and flavour substances possible when using the smokeless cigarette.

The nano-bead solution (4) comprises nano-beads and/or organic substances such as sugars, amino-acids, to which nicotine can be attached, water and/or volatilisation accelerators and further substances named in the course of this paragraph. The nano-beads contained in it comprise mineral materials, preferably aluminium silicates or silicone oxides. The particle sizes vary between 5 nm and 5 [mu]M, preferably 10 nm-100 nm. The nano-particles and/or other organic substances such as sugars, amino-acids etc, interact with nicotine and aroma substances as a result of their large surface or their properties.

The attachment of nicotine to nano-beads or other organic substances in the nano-bead solution (4) is done in a liquid form. In a solution of nicotine and a liquid solvent (volatilisation accelerator), preferably alcohol (ethanol), defined quantities of nano-beads and/or other organic substances such as sugars, amino-acids etc., are added. In order to give the later inhalation air a taste similar to cigarettes, corresponding flavour substances (taste substances) are added to the nano-bead solution (4), in particular menthol and/or tobacco aromas and/or fruit aromas and/or spice aromas in defined quantities. In the course of this manufacturing process, nicotine and flavour substances dock onto the surface of the nano-beads in the solution and/or nicotine and flavour substances dock onto and into organic substances such as sugars, amino-acids. In the factory manufacturing process of the nicotine sticks (5) comprising a depot filter (2) stuck into a mouthpiece filter (3), the nano-bead solution (4) is pipetted or injected into the depot filter (2) via a cannula. The dose of the nano-bead solution (4) is between 50-150 [mu]l, preferably 100 [mu]l, per depot filter (2). Either the depot filters are packed moist and the drying process of the fluid takes place in the package or the filter depots (2) of the nicotine sticks (5) filled with nano-bead solution (4) are subjected to a drying process in the factory directly after manufacture.

Particularly preferably, the smokeless cigarette entails a cigarette tube (1), into which the nicotine stick (5) can be or has been inserted. The cigarette tube (1) is preferably re-usable, as a result of which a minimisation of environmental pollution and saving of costs for the final user is made possible. In practice, the final consumer pulls the cigarette tube and the nicotine stick apart after use, throws the used nicotine stick away and inserts a new nicotine stick into the cigarette tube (1). A principal portrayal of a smokeless cigarette, comprising a nicotine stick (5) and a cigarette tube (1) which have been connected with one another, can be seen from FIG. 12 B.

The cigarette tube (1) has been designed in such a way that it is suitable for the cigarette system according to the invention. The cigarette tube (1) manifests preferably at least one of the following features, particularly preferably a combination of these features.

The cigarette tube (1) is made of plastic, preferably polymer white (PP or PE), cylindrical with an inner bore. The length of the cigarette tube (1) is 55 to 65 mm, preferably 57 mm. The outer diameter is 7-9 mm, preferably 7.9 mm. The inner bore diameter is 4-6.7 mm, preferably 4.5 mm. On each of the open sides, in particular on the connection side to the depot filter/mouthpiece filter, the cigarette tube (1) manifests an approximately 1.0-1.5 mm, preferably 1.0 mm thick support (sealing section) to stabilise the depot filter (2)/mouthpiece filter (3) insert, which form the nicotine stick (5). The sealing section is at a depth of 1-10 mm, preferably 1.3 mm in the bore of the cigarette tube. Further, an inner phase has been attached to the opening ends of the cigarette tube (1) with an inner diameter of 4.5-7.5 mm, preferably 5.0 mm, for better threading of the depot filter (2) into the cigarette tube. The length of the phase is 1-2 mm, preferably 1.3 mm. The air quantity is controlled via the bore of the cigarette tube (1) in an average draw performance (smoking draw) (FIG. 3 cigarette tube).

Further particularly beneficial designs, e.g. material, density or weight, and preferable technical features, in particular dimensions, angles and radii, of the cigarette tube (1) can be seen from FIG. 3.

The new smokeless cigarette essentially comprises 4 parts which are manufactured in the factory or put together in use by the final consumer. Filled nicotine depot (2) and mouthpiece filter (3) are put together to form the nicotine stick (5) in the factory. Nicotine stick (5) and cigarette tube (1) are put together by the user immediately before use.

According to the invention, the cigarette tube (1), depot filter (2) and mouthpiece filter (3) have been shaped in the design of a cigarette and material, mass, bores, density and pore sizes of the filters precisely matched to one another and correspond to one another, in order to ensure the required nicotine supply with a defined draw resistance (normal draw performance).

The production process of the nicotine stick (5) is done in a newly developed production unit, essentially comprising 2 different support shafts. The depot filter (2) and mouthpiece filter (3) are inserted into these support shafts lying horizontally. As a result of the specific design of the shafts, the depot filter (2) and mouthpiece filter (3) are opposite one another in such a way that the depot filter (2), which is the second to last in the shaft, is purposefully guided up to a defined depth into the second-to-last mouthpiece filter by a double ejector pin. During this insertion of the depot filter (2) into the mouthpiece filter (3), the nano-bead solution (4)

is injected into the depot filter (2) via an injection system which is driven via an external dosage system and has been integrated into the upper ejector pin. At the same time, the last finished nicotine stick (5), lowest depot filter (2) inserted into the lowest mouthpiece filter (3), is ejected from the production shaft by the lower ejector pin. When the ejector pins withdraw, the upper nicotine stick (5) now drops down and the complete production cycle starts once more, The production shaft system is to be adapted to the masses of the depot filter (2) and the mouthpiece filter (3). The height of the production shafts is to be designed in such a way that at least a reservoir of 15 to 30 filters is located in the shafts and the upper filters are always replaced by a supply (see nicotine stick robot FIG. 4, FIG. 5, FIG. 6, FIG. 7, FIG. 8, FIG. 9, FIG. 10. FIG. 11).

In practice, the smokeless cigarette is used by the final consumer by him guiding ambient air across the nano-bead solution (5) by simple suction on the mouthpiece, in which context the air in the depot filter is enriched with nicotine and flavour substances, which are then consumed via the mucous membranes in the mouth and/or the lung. Use of the smokeless cigarette is particularly suited as a cigarette substitute in smoke-free areas.

Use of the smokeless cigarette is particularly suited as a means of withdrawal from nicotine by gradual reductions of the nicotine strengths in smoking cessation.

Thus, the invention provides a completely new kind of nicotine inhalator, preferably with the appearance and shape of a cigarette, in which the user consumes pure nicotine in a smokeless way and the symptoms of nicotine withdrawal are prevented and also neither the environment is polluted nor does passive smoking by people not involved take place. Shape, design and packaging of the nicotine inhalator are an imitation of a normal cigarette and influence the psychological and positive effect of a substitute cigarette with smokers.

According to a simple implementation of the invention, a depot filter (2) is charged with nano-bead solution (4) and inserted into a mouthpiece filter up to a defined depth (3). This composition of parts is defined as a nicotine stick (5) and is manufactured and packed in the factory. A re-usable cigarette tube (inhalator tube) (1) is added to the packaging. In use, the user inserts the nicotine stick (5) from the packaging into the cigarette tube (1), smokes the nicotine stick (5) just like a cigarette and disposes of the nicotine stick (5) by pulling it out of the cigarette tube (1) after smoking it, just like a cigarette end. On the other hand, the cigarette tube (1) can be re-used. The nicotine stick (5) has been used up as soon as the flavour fades. Smoking the nicotine stick (5) takes about 3 to 5 minutes, similar to a normal cigarette. This inhalator system according to the invention (cold smoke system) is specifically suited for smokers and is used as a smoke-free substitute cigarette for smokers at places where there is a strict ban on smoking.

EXAMPLE OF APPLICATION

| Aqueous nano-bead solution (50 ul total volume) | Amount of nicotine in the air stream at the outlet of the mouthpiece filter [1] (mg per air volume) | Volatilisation aid |
|---|---|---|
| 2 mg nicotine + 60 ul flavour I | 0.00 | 0.00 |
| 2 mg nicotine + 60 ul flavour I + 0.2 mg nano-beads | 0.25 | none |
| 2 mg nicotine + 60 ul flavour I + 0.2 mg nano-beads | 0.49 | 4 ul grapeseed oil |
| 2 mg nicotine + 60 ul flavour II + 0.2 mg nano-beads | 0.58 | none |
| 2 mg nicotine + 60 ul flavour II + 0.2 mg nano-beads | 1.3 | 4 ul grapeseed oil |

[1] Method: 10-15 draws with 500 ml total draw volume, comparable with cold smoke of a water pipe

LEGEND TO THE ILLUSTRATIONS

Figure 5:
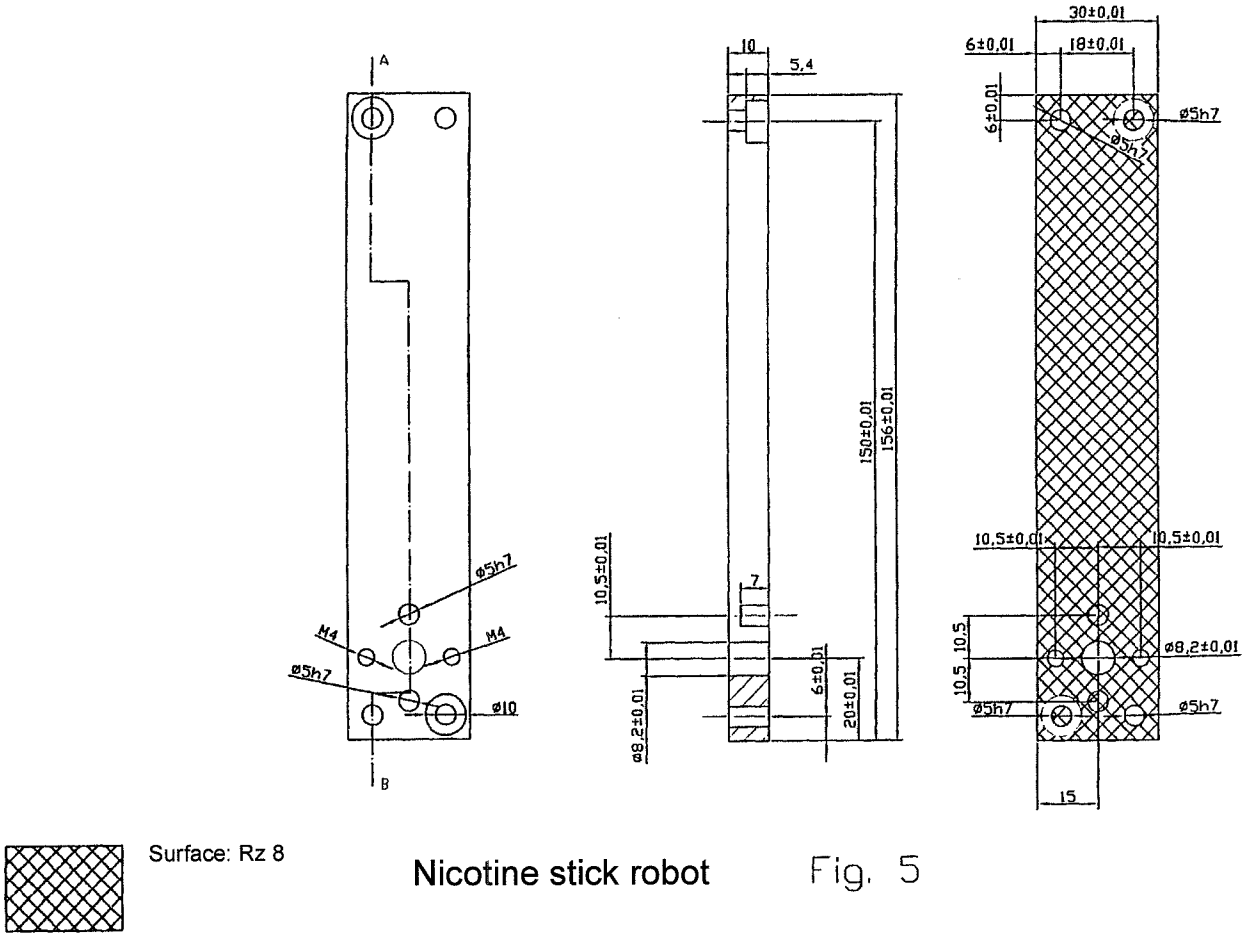
Figure 6:
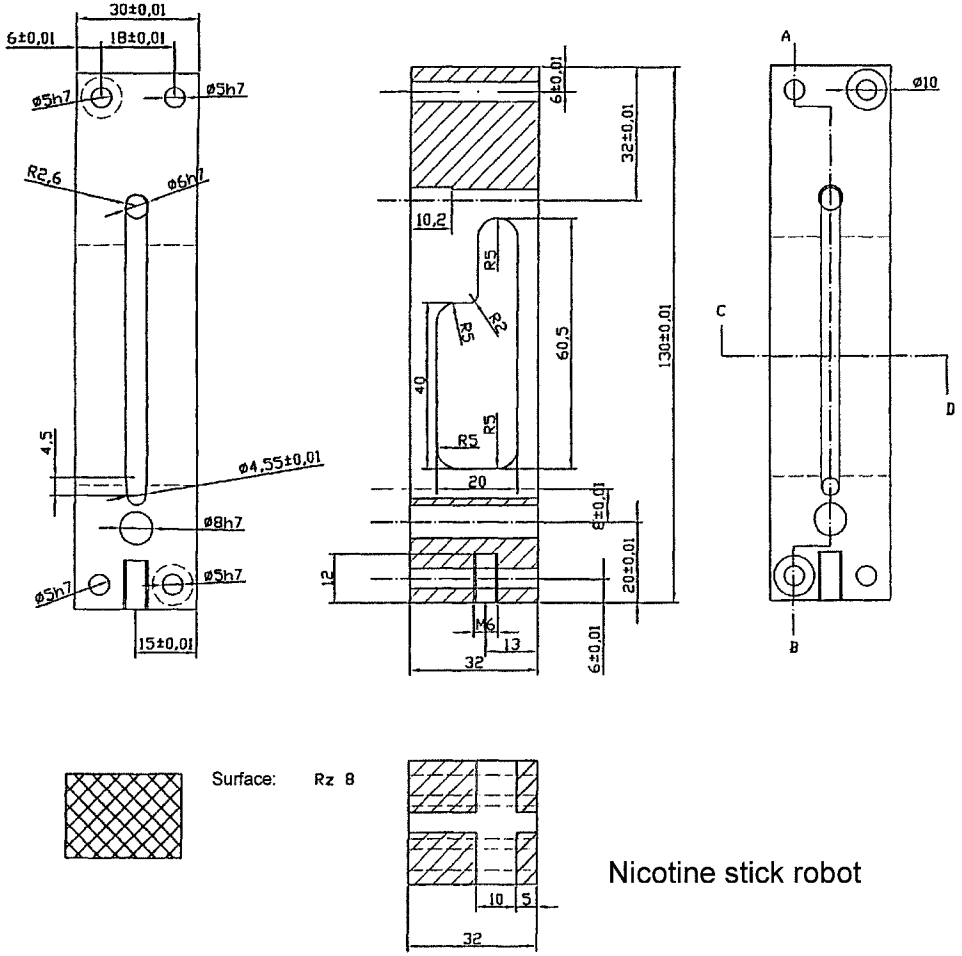
Figure 7:
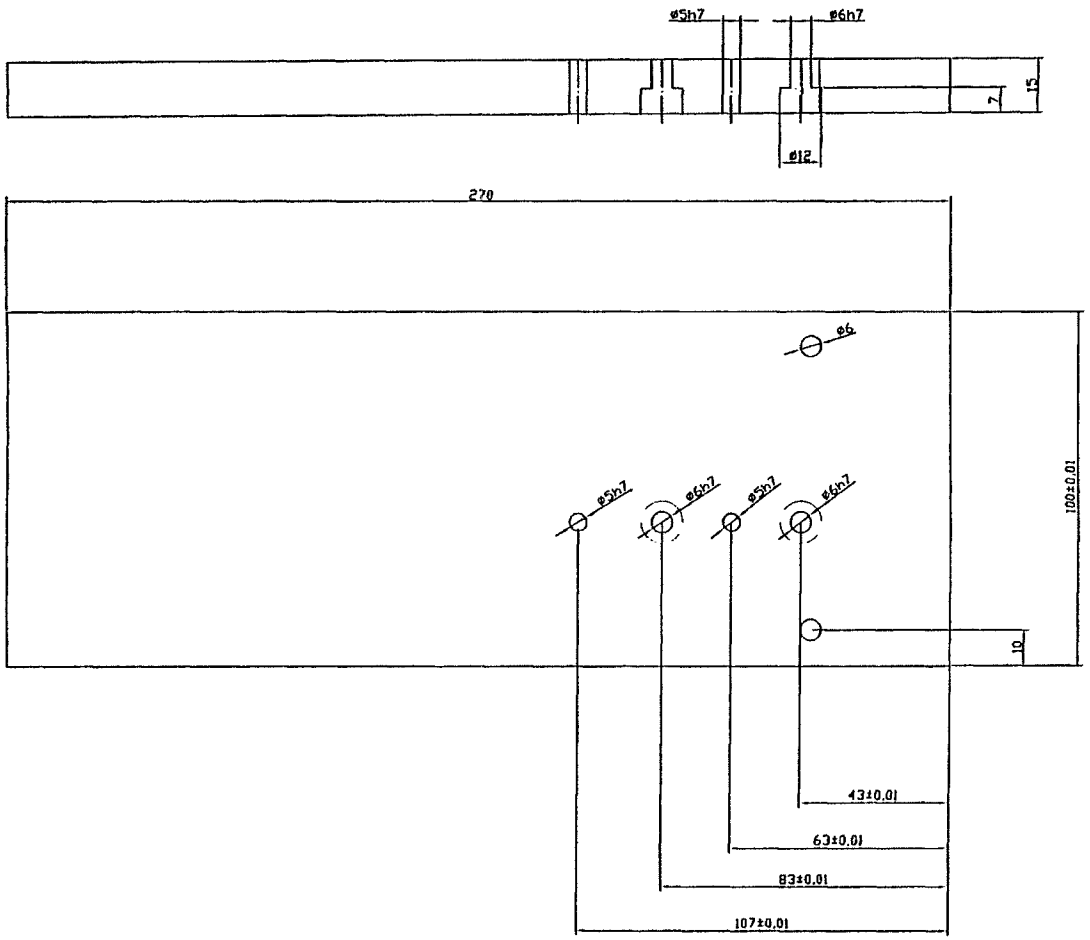
Figure 8:
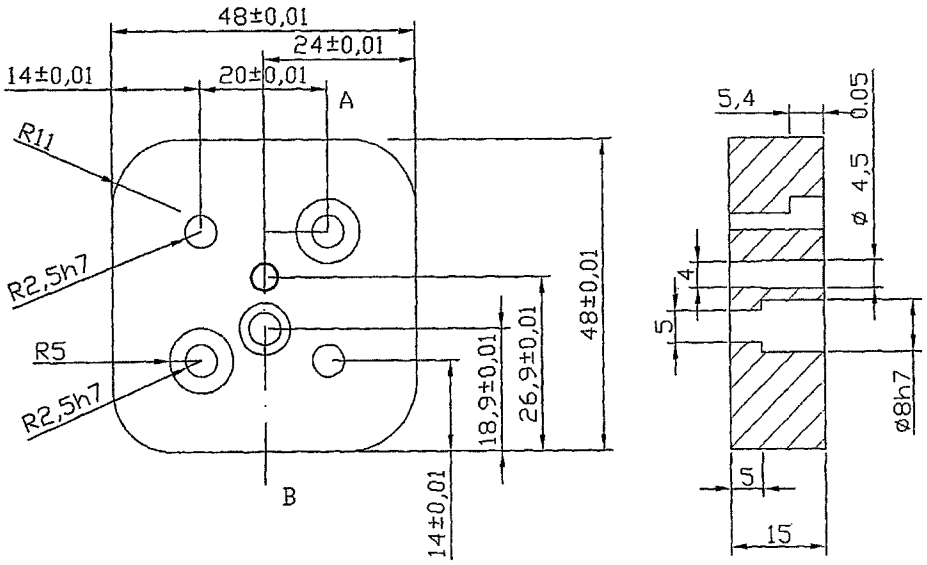

FIG. 1: depot filter
FIG. 2: mouthpiece filter
FIG. 3: cigarette tube
FIG. 4: a nicotine stick robot ejector pin,
FIG. 5: a nicotine stick robot ejector plate,
FIG. 6: a nicotine stick robot depot filter block,
FIG. 7: a nicotine stick robot base plate with preferably ground surface,
FIG. 8: a nicotine stick robot support plate air cylinder,
FIG. 9: a nicotine stick robot mouthpiece filter block,
FIG. 10: a nicotine stick robot
FIG. 11: a nicotine stick robot
FIG. 12 A: principal sketch mouthpiece filter
FIG. 12 B: principal sketch nicotine stick

The invention claimed is:

1. A smokeless cigarette comprising
a depot filter with a defined dimensioned bore, and
a mouthpiece filter with a bore of a defined shape to support the depot filter, and
a volatilization aid and a mineral nano-bead solution located in the depot filter,
wherein:
said mineral nano-bead solution comprises mineral nano-beads to which nicotine and flavor substances are attached, and
the mineral nano-beads are selected from a group consisting of aluminum silicates and silicone oxides, and
the volatilization aid is selected from a group consisting of ethanol and grape seed oil, and
the smokeless cigarette is free of a heating devices or an electrical charging device.

2. The smokeless cigarette according to claim 1, wherein the depot filter inserted or stuck into the mouthpiece filter in such a way that the depot filter and the mouthpiece filter are pressed together with one another, so as to form a nicotine stick.

3. The smokeless cigarette according to claim 1, wherein the mouthpiece filter is inserted or stuck into the depot filter to form a nicotine stick, and the smokeless cigarette further comprises a reusable cigarette tube, into which the nicotine stick is inserted or jammed.

4. The smokeless cigarette according to claim 1, wherein the dimensioned bore configured to the draw resistance of a normal tobacco cigarette.

5. The smokeless cigarette according to claim 1, wherein the defined shape of the bore of the mouthpiece filter is star-shaped.

6. The smokeless cigarette according to claim 1, wherein the mineral nano-beads have particle sizes which vary between 5 nm and 5 μm.

7. The smokeless cigarette according to claim 1, wherein the mineral nano-beads have a sufficiently large surface so as to allow it to interact with nicotine and flavor substances.

8. The smokeless cigarette according to claim 1, wherein the mineral nano-beads are a depot for nicotine and flavor substances and the interaction with nicotine and flavor substances by the mineral nano-beads intensifies taste.

9. The smokeless cigarette according to claim 1, wherein the mineral nano-bead solution comprises mineral nano-beads and organic substances interacting with nicotine and flavor substances.

10. The smokeless cigarette according to claim 1, wherein the depot filter is formed of plastic, is cylindrical with an inner bore, has a length of 25-35 mm, has an outer diameter of 4-5 mm, has an outer bore with an inner bore diameter of 1-2 mm, has a wall thickness of 2-3 mm, and/or is covered with a liquid-resistant, natural colored plastic foil.

11. The smokeless cigarette according to claim 1, wherein the mouthpiece filter is formed of plastic, is cylindrical with a star-shaped inner bore, has a lateral cylindrical part covered with cigarette filter paper, has a length of 24-26 mm, has an outer diameter for 7-9 mm, and/or the inner bore of the mouthpiece filter is star-shaped along the entire length of the inner bore, such that the bore of the mouthpiece filter has 4 to 8 bars and accordingly 4 to 8 grooves, and the diameter of the 4 to 8 grooves measured from a middle groove to another middle groove is 4-5 mm, and the diameter of the bars from a middle bar to an opposite middle bar is 3-4 mm.

12. The smokeless cigarette according to claim 8, further comprising a cigarette tube having at least two open sides, wherein said cigarette tube is formed of plastic, is cylindrical with an inner bore, has a length of 55 to 65 mm, has an outer diameter of 7-9 mm, has an inner bore with a bore diameter of 4-6.7 mm, has a support section or a sealing section which is approximately 1.0-1.5 mm in thickness on each of the open sides, configured to stabilize the depot filter and mouthpiece filter insert, wherein the sealing section is arranged in the bore at a depth of 1-10 mm, and/or has an inner phase with an inner diameter of 4.5-7.5 mm, attached on each of the opening ends, wherein the length of the inner phase is 1-2 mm.

13. The smokeless cigarette according to claim 8, further comprising a cigarette tube wherein said cigarette tube comprises at least two open sides and a support section 1 mm in thickness configured to stabilize the depot filter at a depth of 1.3 mm, has a defined length of 57 mm and a diameter of 7.9 mm, and wherein an inner phase with a diameter of 5.0 mm is attached on each of the open sides, into which the depot filter is configured to be inserted at an angle of 180 degrees.

14. The smokeless cigarette according to claim 8, wherein the depot filter has a length of 30 mm and a diameter of 4.5 mm, an inner bore diameter of 1 mm, a material thickness of 0.220 g/cm$^3$ and a mass corresponding to the calculatory draw resistance of 95-100 mm WS, and the filter is covered with a liquid-resistant plastic coating, so as to guarantee an air flow in the direction of a target.

15. The smokeless cigarette according to claim 8, wherein the mouthpiece filter has a length of 25 mm and a diameter of 7.9 mm, an inner bore in a star shaped design having 6 bars and grooves to secure support and insertion of the depot filter, wherein the bore is 3.4 mm at a narrowest point and 4.5 mm at a widest point and rounding of the bars has a radius of 0.79 mm and the 6 bars are attached centrally at an angle of 60 degrees.

16. The smokeless cigarette according to claim 6 wherein the particle size of the mineral nano-beads vary between 10 nm to 100 nm.

17. The smokeless cigarette according to claim 9 wherein the organic substances are sugar or amino acids.

18. The smokeless cigarette according to claim 1, configured to release nicotine and flavor substances to ambient air in the depot filter with suction force applied to the mouthpiece filter and without heating said nicotine and flavor substances, whereby said ambient air is enriched with said nicotine and flavor substances, thereby provide nicotine to a user in defined doses.

* * * * *